US006231031B1

(12) United States Patent
Michael et al.

(10) Patent No.: US 6,231,031 B1
(45) Date of Patent: May 15, 2001

(54) OUTDOOR RAILING SYSTEM AND RAILS

(75) Inventors: Stephen W. Michael; John M. Pastore, both of Greer; James R. Hall, Jr., Lyman, all of SC (US)

(73) Assignee: Spartanburg Forest Products, Inc., Spartanburg, SC (US)

( * ) Notice: Subject to any disclaimer, the term of this patent is extended or adjusted under 35 U.S.C. 154(b) by 0 days.

(21) Appl. No.: 09/252,593

(22) Filed: Feb. 11, 1999

(51) Int. Cl.[7] ..... E04H 17/14
(52) U.S. Cl. ..... 256/65; 256/60; 256/19
(58) Field of Search ..... 256/59, 60, 65, 256/68, 69, 24, 25, 67, 21–22, 19, 73, 61–64, 71–72; 52/720.2, 690, 736.2, 182, 184, 185, 189, 664, 666, 668

(56) References Cited

U.S. PATENT DOCUMENTS

| | | | | |
|---|---|---|---|---|
| 172,613 | * | 1/1876 | Crowell . | |
| 206,384 | * | 7/1878 | Young . | |
| 300,115 | * | 6/1884 | Obert . | |
| 341,969 | * | 5/1886 | Walker . | |
| 1,353,073 | * | 9/1920 | Schivins . | |
| 1,526,638 | * | 2/1925 | Knight . | |
| 1,871,594 | * | 8/1932 | Duchscher . | |
| 2,477,228 | * | 7/1949 | Bates | 52/669 |
| 2,588,147 | * | 3/1952 | Morris | 256/73 |
| 2,796,236 | * | 6/1957 | Miller . | |
| 2,918,261 | * | 12/1959 | Bergeron . | |
| 3,218,036 | * | 11/1965 | Kozub . | |
| 3,306,641 | * | 2/1967 | Blum et al. . | |
| 3,391,513 | * | 7/1968 | Jones | 52/667 |
| 3,668,828 | * | 6/1972 | Nicholas et al. | 52/92.1 X |
| 3,975,000 | * | 8/1976 | Sado | 256/59 |
| 4,027,855 | * | 6/1977 | Lauzier | 256/21 X |
| 4,408,749 | * | 10/1983 | Zieg | 256/67 |
| 4,421,302 | * | 12/1983 | Grimm et al. | 256/67 X |
| 4,523,419 | * | 6/1985 | Palacio et al. | 52/690 |
| 4,533,121 | * | 8/1985 | Basey | 256/67 X |
| 4,677,806 | * | 7/1987 | Tuomi | 52/656.1 X |
| 5,035,401 | * | 7/1991 | Solter | 256/19 X |
| 5,056,283 | * | 10/1991 | Sapinski | 256/67 X |
| 5,625,987 | * | 5/1997 | Zamerovsky | 52/263 |
| 5,695,175 | * | 12/1997 | Hawkins | 256/67 X |
| 5,964,072 | * | 10/1999 | Rasmussen | 52/666 X |

FOREIGN PATENT DOCUMENTS

| | | | | |
|---|---|---|---|---|
| 2026869 | * | 12/1971 | (DE) | 256/59 |
| 1970 | * | of 1870 | (GB) . | |

* cited by examiner

*Primary Examiner*—Harry C. Kim
(74) *Attorney, Agent, or Firm*—Dority & Manning, PA

(57) ABSTRACT

Top and bottom rails for an outdoor railing system, include a plurality of equally spaced recesses defined in a side of the rails into which spindle ends are fitted. Each of the recesses comprises a multi-sided configuration having an open side defined through an inward edge of the rails so that spindles having a complimentary shaped end can be pressed into the recesses from the sides of the rail.

14 Claims, 4 Drawing Sheets

OUTDOOR RAILING SYSTEM AND RAILS

BACKGROUND OF THE INVENTION

The present invention relates generally to railing systems especially suited for outdoor use, and more particularly to a top and bottom rail configuration for such railing systems.

Railing systems for any number of outdoor applications are well known. For example, residential decks, pool decks, playgrounds, etc., all utilize any number of conventional railing systems. Such decking and railing systems are typically made of pressure treated lumber particularly suited for outdoor use. With conventional railing systems, spindles are vertically disposed between a top and bottom rail. Typically, the spindles are nailed or screwed onto the flat inwardly facing surfaces of the top and bottom rails. In order to provide the railing system with a "finished" appearance, face boards are typically attached to the side edges of the rails thereby defining a generally U-shaped channel with the rails into which the ends of the spindles extend. However, this conventional configuration has significant drawbacks. For example, the U-shaped channel is a favorite nesting place for any manner of insects, including wasps, bees, and the like. Also, this system requires additional materials, for example the side face boards, and is fairly labor intensive in that the spindles must first be screwed or nailed to the top and bottom rails and then the face boards must be attached to the rails. This process and expense is undesirable, particularly in the residential decking industry wherein homeowners frequently install or build their own deck systems.

With another conventional railing system, the spindles are attached to the sides of the top and bottom rail, which are oriented so that their wider sides extend vertically. In other words, the spindles do not extend between the inwardly facing surfaces of the rails, but are nailed or screwed to the longer or wider sides of the rails. The spindles typically include angled ends that "merge" into the sides of the rails. This conventional system also has significant drawbacks. For example, most state building or construction codes require that the rail spindles are not spaced apart beyond a maximum distance. To attach such spindles to the sides of the rails, the spacing must be pre-measured and marked on the rails. Additionally, the spindles also have a tendency to "rack" or bow with respect to the rails over time, particularly with pressure treated lumber wherein the wood tends to alternately lose and absorb moisture. The ends of the spindles tend to pull away from the rails or the spindles bow in the middle and the railing system generally loses its finished uniform look over time.

The present invention relates to an inexpensive and simple railing system that overcomes a number of disadvantages noted with prior art systems.

OBJECTS AND SUMMARY OF THE INVENTION

It is thus a principal object of the present invention to provide an improved railing system particularly suited for outdoor use.

An additional object of the present invention is to provide rails for use in outdoor railing systems that eliminate many disadvantages of conventional rails.

Still an additional object of the present invention is to provide improved prefabricated rail sections that are relatively easy to install.

And yet another object of the present invention is to provide improved top and bottom rails for outdoor railing systems that can accommodate any number of conventional spindles.

Still another object of the present invention is to provide improved outdoor railing system rails that help the railing system retain its finished appearance over a longer period of time without additional expense or processes in building the railing system or manufacturing the rails.

In accordance with the objects and purposes of the invention, a rail is provided for an outdoor railing system wherein a plurality of generally vertically disposed spindles are attached to upper and lower embodiments of the rail. Each rail includes top and bottom edges with first and second opposite sides defined between the edges along the longitudinal length of the rail. The top and bottom edges generally have a width less than that of the sides such that the rail may have, for example, a vertically oriented rectangular profile. The spindles are attachable to the rail along or against one of the sides.

Each rail includes a plurality of generally equally spaced recesses defined along the side in which the spindles are attached. The spindle ends fit into the recesses. Each recess comprises a multi-sided configuration having an open side defined through the bottom edge of the rail so that spindles having a complimentary shaped end can be pressed into the recesses from the sides of the rails.

Thus, it should be understood that according to the invention, the rails are not attached at their ends between inwardly facing sections of the top and bottom rail, but are anchored within recesses defined along the sides of the top and bottom rail. In a preferred embodiment, the recesses are generally U-shaped with the open end of the recess defined in the bottom or inwardly disposed edge of the rails.

Each recess has a configuration so as preferably to engage at least two surfaces of a spindle inserted therein to prevent the spindle from twisting within the recess relative to the rail. In this regard, the spindle need not have a shape or profile that exactly matches the configuration of the rail recess so long as the spindle is engaged by the recess to prevent twisting or movement of the spindle relative to the rail.

In one preferred embodiment, the recesses comprise a generally flat inner face disposed in a generally vertical plane against which a side of a spindle can abut. The end of the spindle may further abut against the top side of the recess. The sides of the recesses are preferably generally flat and defined in planes generally perpendicular to the inner face.

Preferred embodiments of the rails and railing system according to the invention are formed of lumber or wood, particularly pressure treated lumber suited for outdoor use. However, it should be appreciated that the particular materials used in the present invention are not a limitation. For example, the rails may be formed of a plastic or other suitable material.

It should also be appreciated that the rails as described herein are suitable for use as a top or bottom rail in a railing system.

It should also be appreciated that the rails are also suitable for use as a stair rail wherein the rails are disposed at other than a horizontal angle. For example, the rails will generally follow the slope of the stairs. In this embodiment, the recesses are angled at a non-perpendicular angle relative to the edge of the rail so that the spindles can be attached vertically when the rail is used as a non-horizontal stair rail.

The rails according to the invention are also mateable with opposite similarly configured rails such that the sides of the rails having the recesses defined therein are facing or abut each other. In this manner, the recesses align and enclose the spindle ends between the rails. This gives a unique finished appearance to the railing system and allows the rails to accommodate several different styles of spindles that are not particularly suited for attachment to the sides of the rails. For example, many conventional spindles are ornate and have squared ends with flat bottoms that look best when attached between inwardly facing surfaces of the rails. The rails according to the present invention can accommodate such spindles.

The present invention also relates to an outdoor railing system, including pre-fabricated rail sections, having top and bottom rail configurations with a plurality of generally equally spaced spindles attached between the top and bottom rails. Each rail configuration includes at least one top and bottom rail as described above.

In an alternate configuration of the railing system, two such rails are provided for each top and bottom rail configuration such that the spindles are "sandwiched" between the facing rails. As discussed above, in this configuration the uniquely configured rails can accommodate a vast number of conventional spindles.

Preferred embodiments of the rails and railing system will be described below in greater detail through use of the attached figures.

DETAILED DESCRIPTION

Figure 1:
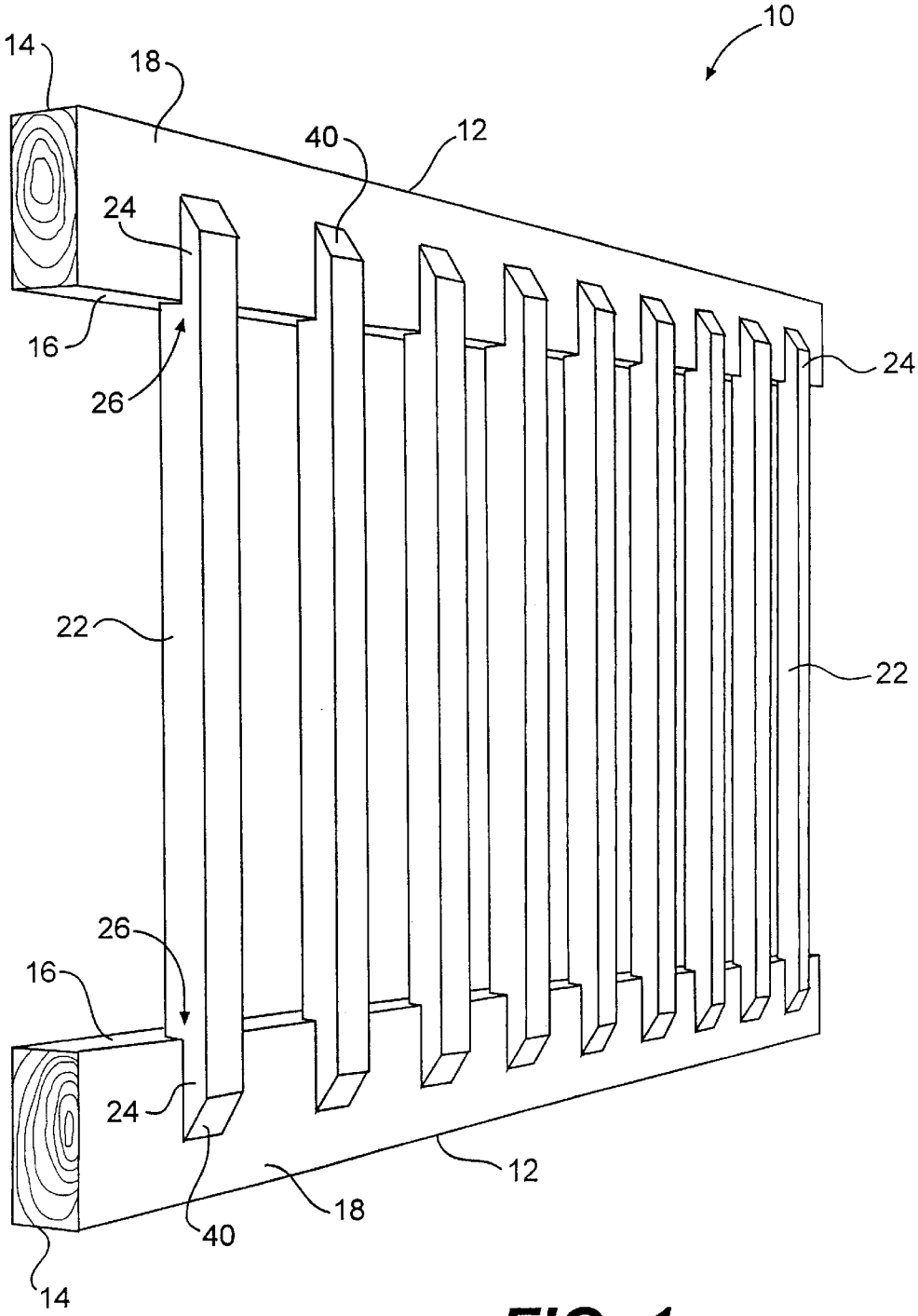
FIG. 1 is a perspective view of a railing system incorporating the unique rails according to the invention.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a third embodiment. It is intended that the present invention include such modifications and variations as come within the scope and spirit of the present invention.

An outdoor railing system, generally 10, according to the invention is illustrated in FIG. 1. Railing system 10 is illustrated as a pre-fabricated section of a complete rail for purposes of illustration. The present invention includes such pre-fabricated sections as well as a complete railing system constructed in accordance with the invention. The present invention also includes top and bottom rails 12 separately for use in such railing systems.

Conventional outdoor decking and rail systems are typically made from wood, particularly pressure-treated lumber. The present invention includes rails and railing systems made of wood, but is not limited to any particular material. For example, the components of the railing system 10 or rails 12 may be fabricated from any conventional construction material, including plastic, cementious materials, and the like. Any and all such materials suitable for railing systems are within the scope and spirit of the invention.

Referring again to FIG. 1, railing system 10 includes upper and lower rails, generally 12. Each rail 12 includes an outward edge 14 and inwardly facing edge 16. Opposite sides, including side 18, are defined between the edges. Rails 12 are preferably oriented so that wider sides 18 extend in a vertical direction. In this regard, rails 12 may comprise a conventional two-by-four or two-by-six oriented as illustrated in FIG. 1.

Spindles 22 are connected or attached to rails 12 along side 18 along the longitudinal length of the rails. It should be appreciated that the present invention is not limited to any particular type of spindles 22, and that the rectangular profile spindles illustrated in the figures is for illustrative purposes only.

A plurality of generally equally spaced recesses 26 are defined along the longitudinal length of rail 12 in face 18. As is generally illustrated in FIG. 1, ends 24 of spindles 22 rest or are nested within recesses 26. The recesses are illustrated in greater detail in FIGS. 2 and 3. Each recess 26 has an open side 28 defined in side 18 of rail 12, and an open end 30 defined in edge 16. Preferably, a generally flat inner face 34 is defined essentially parallel to side 18. An end side 33 is defined between generally flat sides 32. In this regard, in the preferred embodiment illustrated in the figures, each recess 26 is generally U-shaped.

Each recess 26 has a size so as to accommodate an end 24 of the spindles. In this regard, end 24 can be pressed into rail 12 from side 18. The back side of spindle end 24 preferably abuts against flat face 34 and the sides of spindle end 24 preferably abut against sides 32 of recess 26. Likewise, the end of spindle 24 preferably abuts against side 33 of recess 26.

It should be appreciated that recesses 26 can take on any manner of shape or configuration so long as they engage against enough surfaces of spindle end 24 to prevent the spindles from twisting or torquing relative to rails 12. The spindle ends 24 may be further secured within recesses 26 by any other conventional means, including nails 38, adhesives, and the like.

Figure 2:
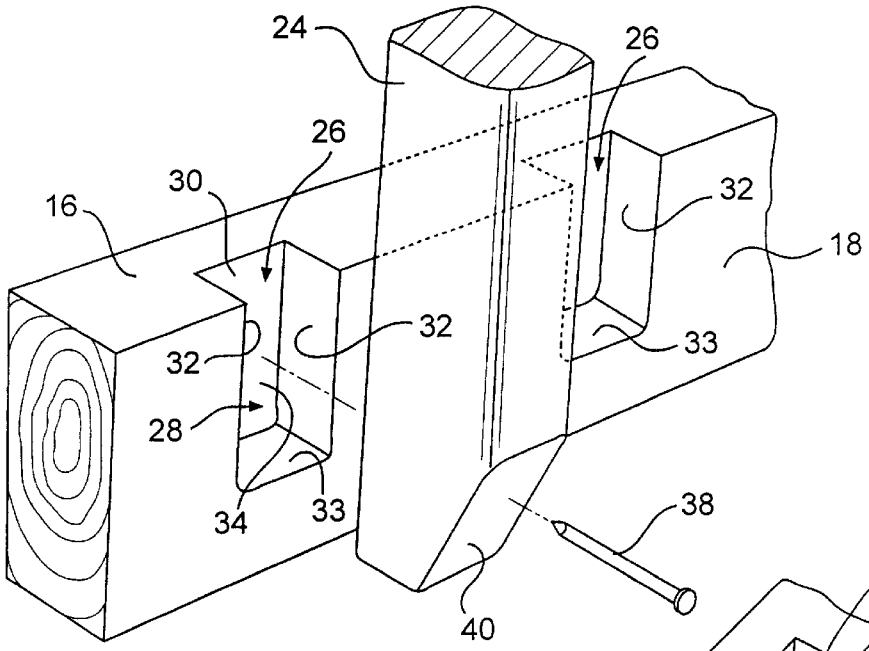
FIG. 2 is a perspective assembly view of a rail and spindle configuration according to the invention.
Figure 3:
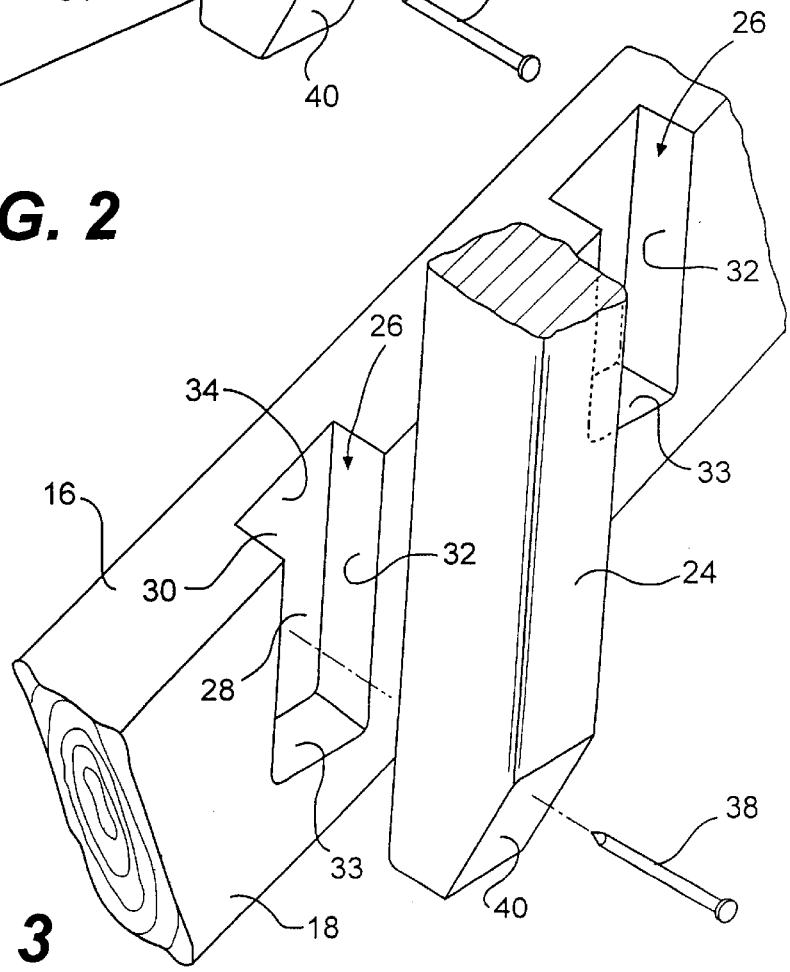
FIG. 3 is a perspective assembly view of a rail and spindle configuration according to the invention wherein the rail is utilized as a non-horizontal stair rail.

The configuration illustrated particularly in FIGS. 1 and 2 provides for a relatively simple means for securing the spindles 22 relative to rails 12 while ensuring that the railing system 10 maintains a professional finished look over a longer period of time. The recesses 26 are preferably spaced apart according to building codes or restrictions so that spindle spacing and measurement is no longer a concern and it is a relatively simple matter to simply press spindles 22 into recesses 26 and nail or otherwise permanently secure the spindles relative to the rails.

The depth of recesses 26, or width of sides 32, is not particularly critical so long as recesses 26 are sized so as to accommodate spindle ends 24 taking into account shrinkage and expansion of the spindles as they alternately lose and absorb moisture over time. Also, recesses 26 should not be defined so as to structurally weaken rails 12.

For ease of manufacture, recesses 26 are preferably formed as illustrated in FIG. 2 with sides 32 and 33 essentially perpendicular to face 18. Likewise, innerface 34 is generally parallel to side 18. This configuration also complements conventional rectangular or square ended spindles. However, it should be appreciated that recesses 26 may be defined by other than flat or straight sides depending on the end configuration of the spindles. It is preferred that at least two sides of the spindle ends abut directly against at least two sides or surfaces of recess 26 so as to ensure that the spindles do not twist relative to rails 12.

Figure 4:
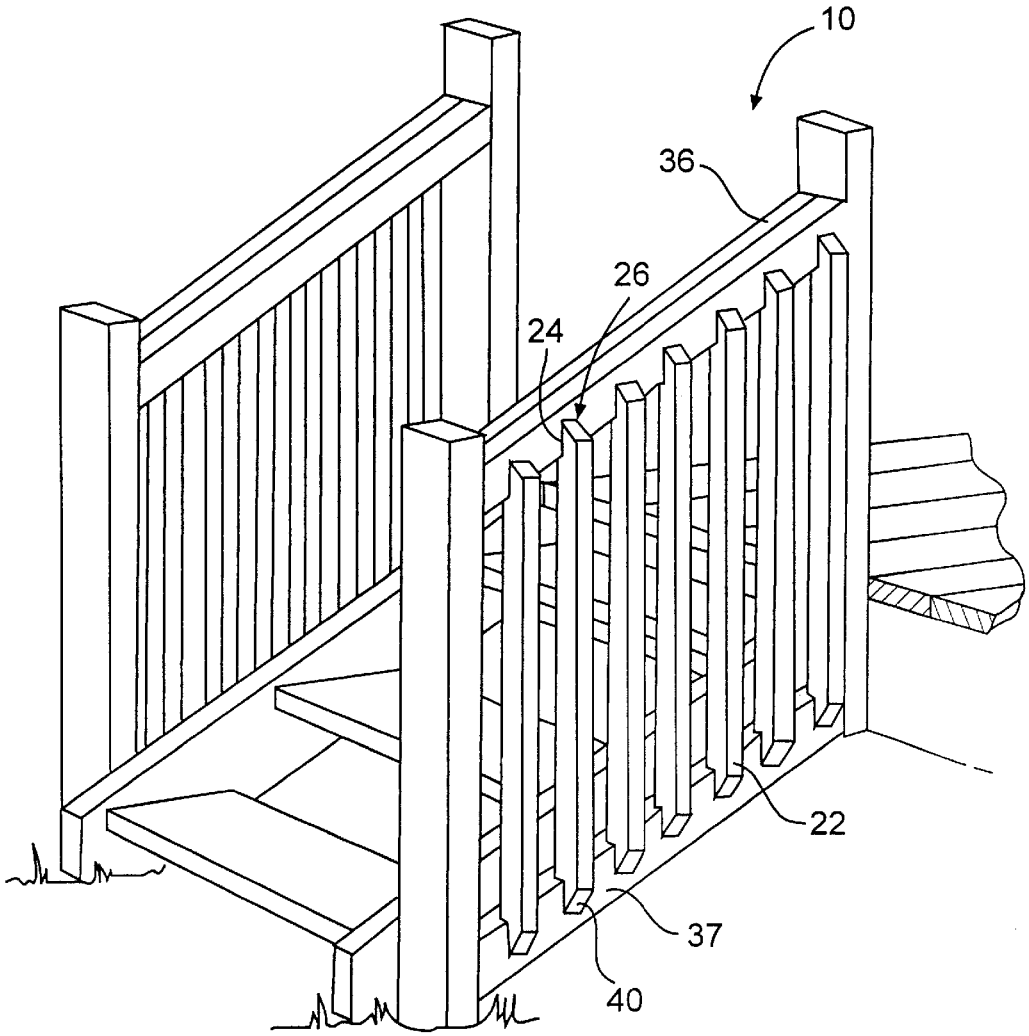
FIG. 4 is a perspective view of a stair rail according to the invention.

Rails 12 according to the invention, and a railing system incorporating rails 12, may also be used as a conventional stair rail, as illustrated in FIG. 4. Here, top stair rail 36 and bottom stair rail 37 are illustrated. Rails 36 and 37 are constructed substantially identical to rails 12 as described above with the exception that recesses 26 are at a non-perpendicular angle relative to edge 16, as particularly illustrated in FIG. 3. In this manner, rails 22 may extend vertically even though the rails are oriented in a non-horizontal manner, as illustrated in FIG. 4. It may be preferred that end side 33 is defined so as to extend horizontally at the angled inclination of the rail. Thus, ends 33 act to vertically align the spindles.

Figure 5:
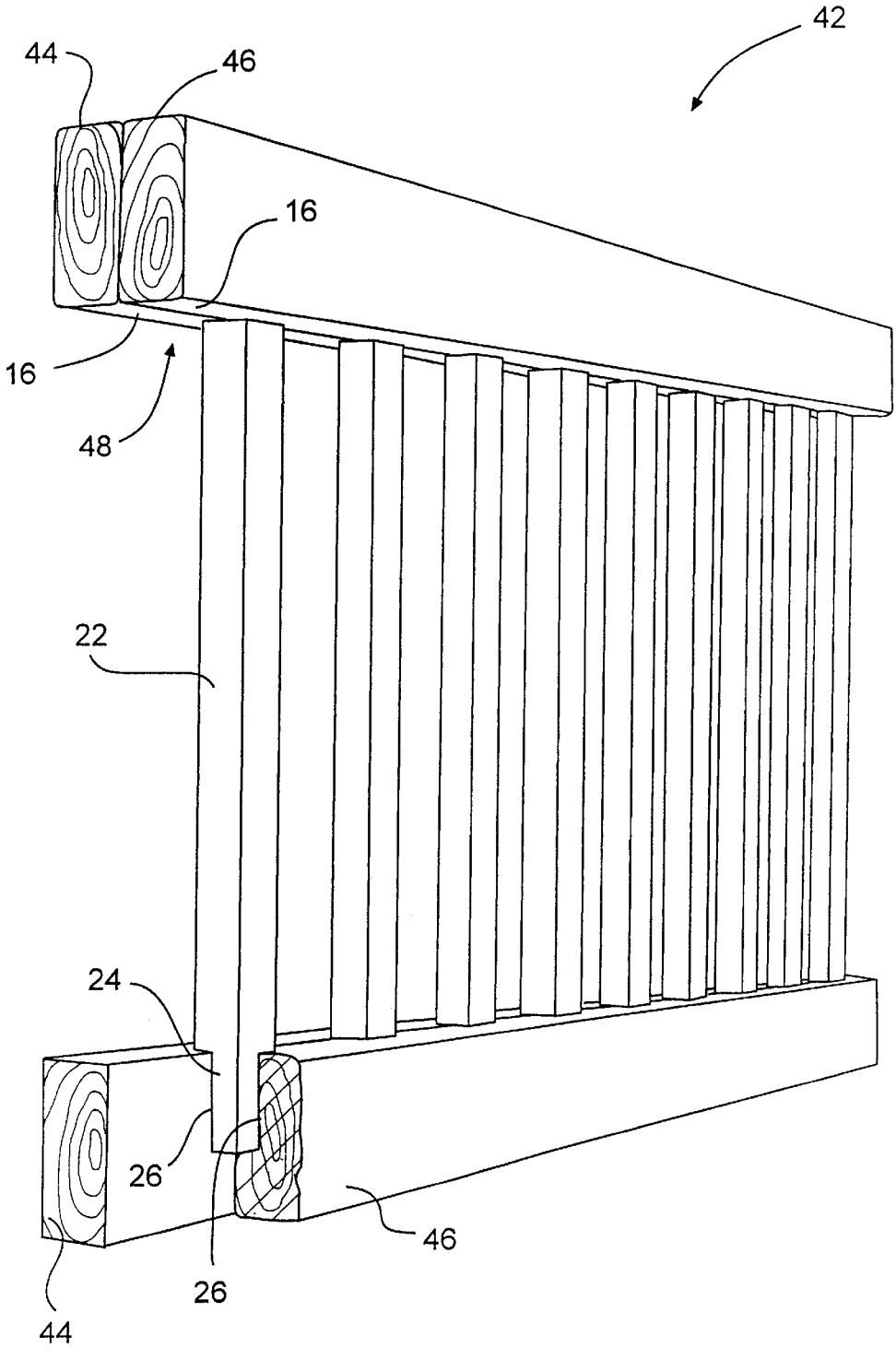
FIG. 5 is a perspective partial cut-away view of an alternative rail configuration according to the invention utilizing two top and bottom rails.

An alternate preferred railing system 42 according to the invention is illustrated in FIG. 5. In this embodiment, a first rail 44 and second rail 46 are joined as the top and bottom rails such that recesses 26 in each of the first and second rails face each other. Rails 44 and 46 are generally constructed as described above with regards to rails 12 of FIG. 1. In the embodiment of FIG. 5, the opposite recesses 26 of the joined first and second rails "sandwich" spindle ends 24. This configuration gives a unique appearance to the finished railing system in that the spindles appear to be connected between inwardly facing surfaces 48 comprised of joined edges 16. This configuration also obviously securely locks the spindles within the rails.

The embodiment of FIG. 5 is also particularly useful in that it can accommodate any number of conventional spindles that are particularly suited to extend between inwardly facing surfaces of a top and bottom rail. For example, although not illustrated in FIG. 5, a vast number of conventional spindles have an ornate turned configuration in the middle portion thereof, and such spindles are generally only used between inwardly facing surfaces of rails. With prior are conventional rail systems, the ends of such spindles are nailed or screwed to the inwardly facing rail surfaces and face or side boards are then nailed to the top and bottom rails to give the rail a "finished" appearance. However, this construction defines a generally U-shaped channel along the rails that is a favorite nesting place for insects, including wasps, bees, and the like. Also, this configuration does not prevent the spindles from twisting or bowing relative to the rails, and requires additional materials and labor. The embodiment of FIG. 5 is relatively simple yet provides a professional finished appearance to the rail system that is maintained over a longer period of time due to the fact that the spindles are prevented from twisting or turning relative to the rails.

It should be appreciated by those skilled in the art that various modifications and variations can be made in the present invention without departing from the scope or spirit of the invention. For example, the recesses defined in the rails may take on any shape sufficient for preventing the spindles from twisting or turning relative to the rails. It is intended that the present invention include such modifications and variations as come within the scope of the appended claims and their equivalents.

What is claimed is:

1. An outdoor railing system comprising:

a first rail comprising top and bottom edges with first and second opposite sides between said edges defined along the longitudinal length thereof;

a second rail comprising top and bottom edges with first and second opposite sides between said edges defined along the longitudinal length thereof, said second rail spaced parallel to and below said first rail;

a third rail comprising top and bottom edges with first and second opposite sides between said edges defined along the longitudinal length thereof;

said first side of said third rail adjacent the first side of said first rail;

a fourth rail comprising top and bottom edges with first and second opposite sides between said edges defined along the longitudinal length thereof, said fourth rail spaced parallel to and below said third rail, said first side of said fourth rail opposite the first side of said second rail;

a plurality of generally equally spaced recesses defined in each of said first, second, third, and fourth rails along said respective first sides, each of said recesses further comprising a multi-sided configuration having a single open side defined through said bottom edge of said first and third top rails and through said upper edge of said second and fourth bottom rails; and, a plurality of vertically disposed spindles, each individual spindle having a first end and a second end defining a shape complementary to said recesses so that a first height portion of the spindles can be pressed into said recesses along said first sides of said first and second rails and a second height portion extending above a plane defined by a surface of each of first sides of said first rail and said second rail;

said spaced recesses defined by said third rail opposite said spaced recesses of said first rail, thereby enclosing the first spindle ends between said adjacent first rail and said third rail; and, said spaced recesses defined by said fourth rail being opposite said spaced recesses of said adjacent second rail, thereby enclosing the second spindle ends between said second rail and said fourth rail.

2. The railing system as in claim 1, wherein said recesses comprise a generally flat inner face disposed in a generally vertical plane against which a side of the spindle can abut.

3. The railing system as in claim 2, wherein said recesses are generally U-shaped.

4. The railing system as in claim 2, wherein said recesses comprise generally flat sides defined in planes generally perpendicular to said inner face.

5. The railing system as in claim 1, wherein said recesses have a configuration so as to engage at least two surfaces of the spindle and inserted therein to prevent the spindle from twisting relative to said first and second rails.

6. The railing system as in claim 1, wherein said rails are made of wood.

7. The railing system as in claim 1, wherein said first and third rails are configured as a stair rail and said recesses are angled at a non-perpendicular angle relative to said bottom edge so that the spindles can be attached vertically when said first and third rails are used as a non-horizontal stair rail, said second and fourth rails positioned substantially parallel to and below said first and said third rails.

8. An outdoor railing system, comprising:

a first pair of rail members and a second pair of rail members;

each of said first and second pairs of the rail members further comprising;

top and bottom edges with first and second opposite sides between said edges defined along the longitudinal length thereof;

a plurality of generally equally spaced recesses defined in each said rail member along said first side;

each of said recesses further comprising a multi-sided configuration having an open side defined through said first side;

a plurality of generally equally spaced spindles attached between said first pair of rail members and said second pair of rail members, said spindles having opposite, first and second complementary shaped spindle ends, each of said plurality of spindle ends further defining a height, a first portion of said spindle height of said first spindle ends fit into one of said plurality of recesses along a first member of said first pair of rail members and a second portion of said spindle height of said first spindle end fit into one of said plurality of recesses defined along a second member of said first pair of rail members, thereby enclosing said first spindle end between said first pair of rail members; and, a first portion of said spindle height of said second spindle ends fit into one of said plurality of recesses along a first member of said second pair of rail members and a second portion of said spindle height of said second spindle ends fit into one of said plurality of recesses defined along a second member of said second pair of rail members, thereby enclosing the second spindle ends between said second pair of rail members.

9. The railing system as in claim 8, wherein said system comprises a pre-fabricated length of said first and second pairs of the rail members with said spindles anchored within said recesses.

10. The railing system as in claim 8, wherein said recesses comprise a generally flat inner face disposed in a generally vertical plane against which a side of said spindles abut.

11. The railing system as in claim 10, wherein said recesses are generally U-shaped.

12. The railing system as in claim 10, wherein said recesses comprise generally flat sides defined in planes generally perpendicular to said inner face.

13. The railing system as in claim 8, wherein said recesses have a configuration so as to engage at least two surfaces of said spindles inserted therein to prevent said spindles from twisting relative to said rail member.

14. The railing system as in claim 8, wherein said railing system is configured as a stair rail and said recesses are angled at a non-perpendicular angle relative to one of said top or bottom edges so that said spindles are attached vertically in a non-horizontal disposition of said rail members.

* * * * *